United States Patent [19]

Ruger

[11] 4,290,220

[45] Sep. 22, 1981

[54] LIGHTWEIGHT STOCK AND FRAME CONSTRUCTION FOR A FIREARM

[75] Inventor: William B. Ruger, Croydon, N.H.

[73] Assignee: Sturm, Ruger & Co., Inc., Southport, Conn.

[21] Appl. No.: 55,643

[22] Filed: Jul. 9, 1979

[51] Int. Cl.[3] ..... F42C 23/00

[52] U.S. Cl. ..... 42/75 D; 42/71 R; 42/75 C

[58] Field of Search ..... 42/71 R, 75 D, 75 C

[56] References Cited

U.S. PATENT DOCUMENTS

| | | | |
|---|---|---|---|
| D. 241,836 | 10/1976 | Ruger et al. | 42/71 R |
| 1,731,844 | 10/1929 | Diener | 42/75 C |
| 2,288,901 | 7/1942 | Green | 42/75 C |
| 3,739,515 | 6/1973 | Koon, Jr. | 42/71 R |
| 3,984,933 | 10/1976 | Ruger | 42/47 |
| 4,063,379 | 12/1977 | Ruger | 42/75 D |

*Primary Examiner*—Charles T. Jordan
*Attorney, Agent, or Firm*—Pennie & Edmonds

[57] ABSTRACT

The lightweight stock and frame construction for a firearm involves replacing a substantial portion of the side walls of the metal frame with forwardly extending portions of the side walls of the wooden or plastic stock. Specifically, the right hand and left hand sides of the stock are provided with right and left hand side wall extensions that extend forwardly from the forward end of the stock on each side thereof, and the right and left hand side walls of the frame are formed with openings conforming in shape to and adapted snugly to receive the said forwardly extending side wall extensions of the stock. The peripheries of the right hand and the left hand side wall extensions of the stock are each formed with an inwardly rising bevelled surface, and the peripheries of the right hand and the left hand side wall openings of the frame are each formed with an inwardly undercut bevelled surface that is adapted to contact snugly the inwardly rising bevelled surface of the periphery of the corresponding side wall extension of the stock. Inner support members are disposed on the inside surface of both the right and left hand side walls of the frame adjacent the forward ends of the right and left hand openings formed therein, these support members being adapted to contact and support the inner surfaces of the right hand and left hand side wall extensions of the stock at the forward ends thereof.

5 Claims, 6 Drawing Figures

LIGHTWEIGHT STOCK AND FRAME CONSTRUCTION FOR A FIREARM

TECHNICAL FIELD

This invention relates to firearms having a frame, a barrel pivotally mounted on the forward end of the frame and a stock secured to the rearward end of the frame, and more particularly to a lightweight construction for such firearms wherein portions of the side walls of the frame are cut away to reduce the weight of the firearm and improve its performance and appearance.

BACKGROUND ART

Rifles and shotguns of the break-open type commonly comprise a frame, one or more barrels pivotally mounted on the forward end of the frame and a stock secured to the rearward end of the frame. The rearward end of the barrel of a single barrel firearm and, in particular, the rearward ends of the barrels of a double barrel firearm of the over-and-under type are usually mounted in a barrel-receiving block that, in turn, is pivotally mounted in an open-top recess formed in the forward end of the frame. The barrel-receiving block and the barrels mounted thereon are adapted to be rotated from their closed ready-to-fire position to their open loading and unloading position in the manner known in the art. The open-top recess of the frame in which the barrel-receiving block is received is defined by right hand and left hand side walls of the frame, a bottom wall of the frame and a rear end wall of the frame. The forward end of the stock abuts against this rear end wall of the frame along a more or less vertical line. This general type of stock and frame construction is conventional in the prior art and is exemplified by the external appearance of the frame and stock of the over-and-under shotguns shown in U.S. Pat. Nos.

3,984,933 and 4,063,379 issued to William B. Ruger on Oct. 12, 1976 and Dec. 12, 1977, respectively.

A conventional shotgun or rifle can be quite tiring for a person to carry about and to shoot throughout a long day in the field or at the trap or skeet range, and this can have an adverse effect on the accuracy of the person's shots. As a result, much time and effort has been expended devising ways to reduce the weight of conventional firearms without adversely affecting the balance or performance of the firearms. For example, the frame of an over-and-under firearm is usually a relatively massive metal casting or machined forging that contributes substantially to the total weight of the firearm, and any reduction in the weight of this part that does not affect its strength or function would be an important benefit to the shooter. With this in mind, one attempt to reduce the weight and, equally importantly, improve the appearance of an over-and-under shotgun is shown in U.S. Pat. No. De. 241,836 issued to William B. Ruger and Lawrence L. Larson on Oct. 12, 1976. In this design the side walls of the metal frame of the shotgun are cut away in an area of the frame not subjected to great mechanical stress, and the sides of the wooden stock are extended forwardly to take the place of the metal removed from the frame. The resulting over-and-under shotgun is not only appreciably lighter in weight than shotguns of conventional construction but is also very pleasing in its appearance or aesthetic appeal. Unfortunately, despite the aesthetic appeal of the new design there was at the time of its conception no mechanically satisfactory way to secure the forward extensions of the side walls of the stock to the sides of the frame, and as a result the insecurely fitted side wall extensions of the stock tended to flex or bend in the hands of the shooter and so was an unsatisfactory and incomplete solution to the problem. After an intensive investigation into the problems encountered in the design of lightweight firearms and, in particular, the difficulty in providing a mechanically satisfactory way to secure the forward extensions of the side walls of the stock to the sides of the frame of the over-and-under shotgun shown in U.S. Pat. De. 241,836, I have devised a novel stock and frame construction for lightweight firearms similar to U.S. Pat. De. 241,836, my improvement providing a simple yet mechanically secure connection between the stock and the frame that completely eliminates the objectionable play or looseness in the fit of these parts that previously interfered with the handling and performance of shotguns of the patented design.

DISCLOSURE OF INVENTION

The lightweight stock and frame construction of the invention is applicable to firearms having a frame, at least one barrel pivotally mounted in an open-top recess formed in the forward end of the frame, and a stock secured to the rearward end of the frame. The side walls of the frame are formed with cut-out portions and the stock is provided with right hand and left hand side wall extensions that extend forwardly into the cut-out portions of the side walls of the frame to replace the metal removed from the frame in these areas. Specifically, the right hand and left hand side walls of the stock are provided with right hand and left hand side wall extensions that extend forwardly from the forward ends of the side walls of the stock on each side thereof, and the right and left hand side walls of the frame are formed with openings conforming in shape to and adapted snugly to receive the said forwardly extending side wall extensions of the stock. The periphery of the right and left hand side extensions of the side walls of the stock are each formed with an inwardly rising bevelled surface and the periphery of the side wall extension receiving openings of the frame are each formed with an undercut bevelled surface that is adapted to contact snugly the inwardly rising bevelled surfaces of the periphery of the corresponding side wall extension of the stock. Inner support members are deposed on the inside surface of both the right and left hand side walls of the frame adjacent the forward ends of the right and left hand side wall openings formed therein, these support members being adapted to contact and support the inner surface of the right and left hand side wall extensions of the stock that are received in the said right and left hand side wall openings formed in the frame.

When the right and left hand side wall extensions of the stock are received in the right and left hand side wall openings formed in the frame, the inwardly rising bevelled surfaces of the peripheries of the said right hand and left hand side wall extensions and the undercut bevelled surfaces of the peripheries of the said side wall openings cooperate to prevent the side wall extensions of the stock from moving laterally outwardly out of the openings formed in the frame. Similarly, the inner support members disposed at the forward end of the side wall openings of the frame contact and support the forward ends of the said right and left hand side wall extensions to prevent inward lateral movement of these side wall extensions of the stock. As a result, the forwardly extending right and left hand side wall extensions of the side walls of the stock are securely held in the right and left hand side wall openings of the frame to completely eliminate the objectionable play or looseness in fit of these parts heretofore experienced.

BRIEF DESCRIPTION OF THE DRAWING

The lightweight stock and frame construction of the invention will be better understood from the following detailed description thereof in conjunction with the accompanying drawings of which.

BEST MODE FOR CARRYING OUT THE INVENTION

As previously noted, the lightweight stock and frame construction of the invention is applicable to rifles and shotguns of the breakopen type having a frame, one or more barrels pivotally mounted on the forward end of the frame and a stock secured to the rearward end of the frame. An over-and-under shotgun embodying my new stock and frame construction is shown in the accompanying drawings, and the invention will be described in conjunction therewith although, it will be understood, it is not limited thereto.

Figure 1:
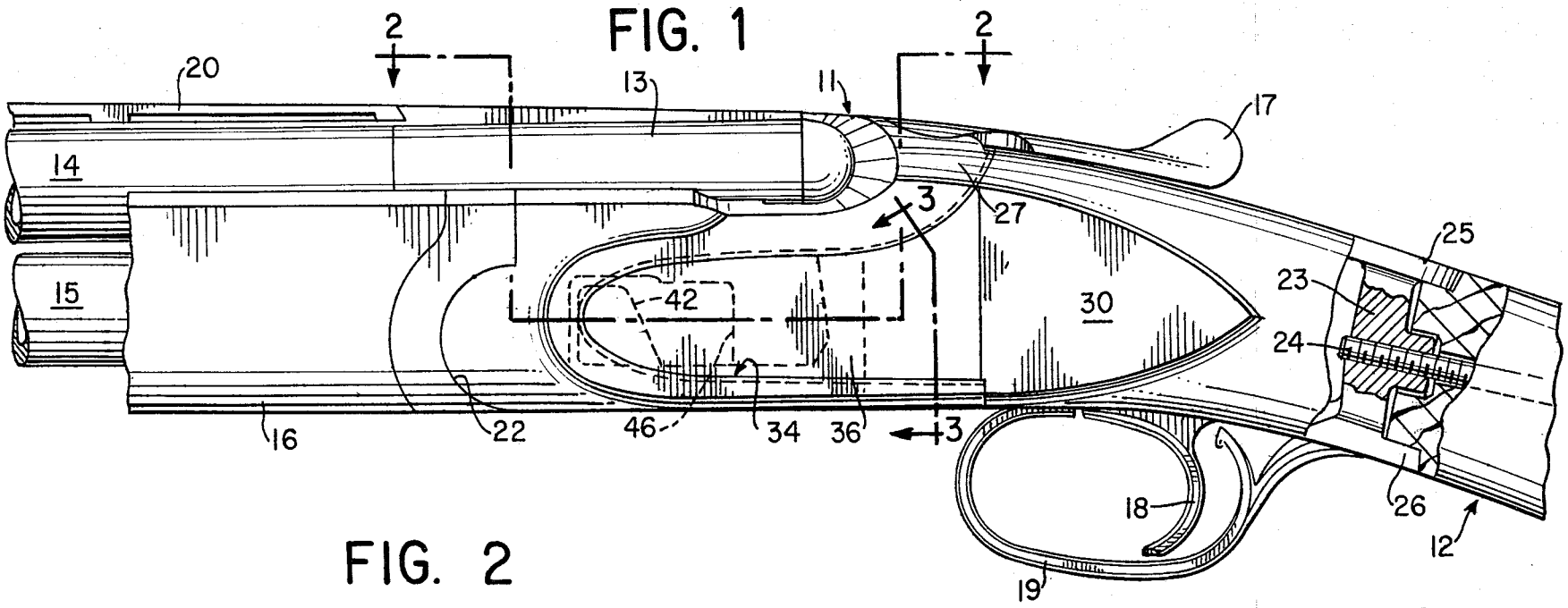
FIG. 1 is a fragmentary side elevation of an over-and-under shotgun embodying the lightweight frame and stock construction of the invention.
Figure 3:
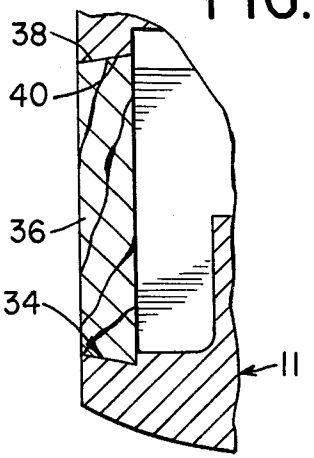
FIG. 3 is a fragmentary sectional view along line 3—3 of FIG. 1.

The over-and-under shotgun shown in FIG. 1 of the drawings comprises, in its major externally visible components, a frame 11, a stock 12 secured to the rearward end of the frame, a barrel-receiving block 13 pivotally mounted on the forward end of the frame, an upper barrel 14 and a lower barrel 15 mounted on the barrel-receiving block 13, and a forearm 16. Other externally visible parts include the top lever 17, the trigger 18 and trigger guard 19 which are mounted on the frame 11 and the sighting rib 20 that is mounted on the upper barrel 14. The barrel-receiving block 13, upper and lower barrels 14 and 15 and forearm 16 together form a unitary assembly that is pivotally mounted on the forward end of the frame for rotation about the arcuate hinge surface 22 from their closed ready-to-fire position shown in FIG. 1 to their open loading and unloading position (not shown in the drawings) in the manner known in the art. The stock 12 is secured to the rearward end 23 of the frame 11 by means of the screw 24 as also shown in FIG. 1 of the drawing.

Figure 5:
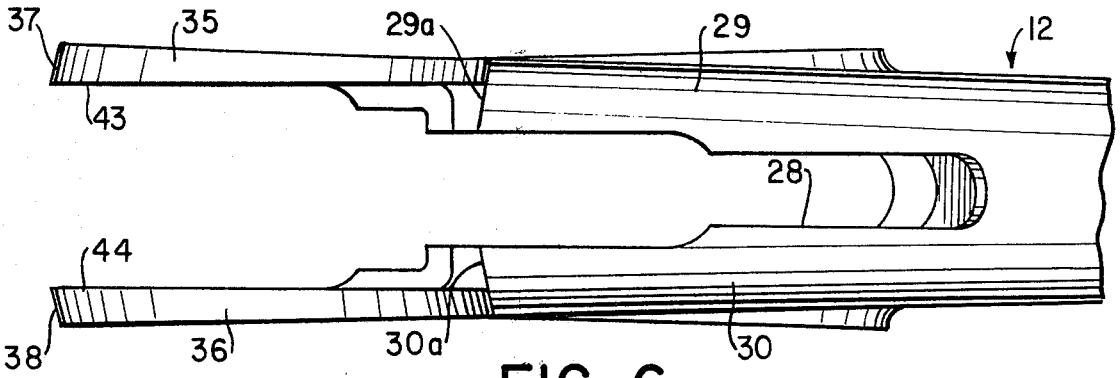
FIG. 5 is a top view of the forward end of the stock showing the right hand and left hand side wall extensions of the stock.
Figure 6:
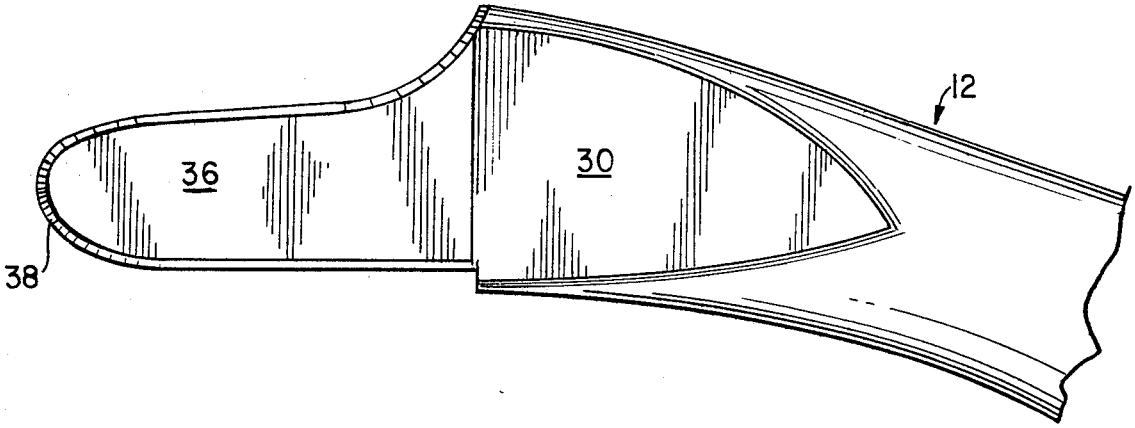
FIG. 6 is a side elevation of the forward end of the stock shown in FIG. 5.

The frame 11 is provided with upper and lower tang-like portions 25 and 26 that extend rearwardly from the main or central portion 27 of the frame, the main components of the firing mechanism of the shotgun being mounted on and deposed between the said upper and lower tang-like portions of the frame. The forward end of the stock 12 is formed with a longitudinally extending cut-out portion 28 that extends vertically through the stock from the upper surface to the lower surface thereof as shown in FIGS. 5 and 6 of the drawings, the essentially vertical side walls 29 and 30 at the forward end of the stock 12 comprising the side walls of the cut-out portion 28. The cut-out portion 28 of the stock 12 is adapted to receive the rearwardly extending tang-like portions 25 and 26 of the frame together with the firing mechanism mounted thereon. When the rearwardly extending tang-like portions 25 and 26 of the frame are received in the cut-out portion 28 of the stock 12, the screw 24 presses the forward end of the stock firmly against the rearwardly facing surfaces of the central portion of the frame, thereby eliminating any tendency of the side walls 29 and 30 of the stock to shift or flex when the shotgun is in use.

Figure 4:
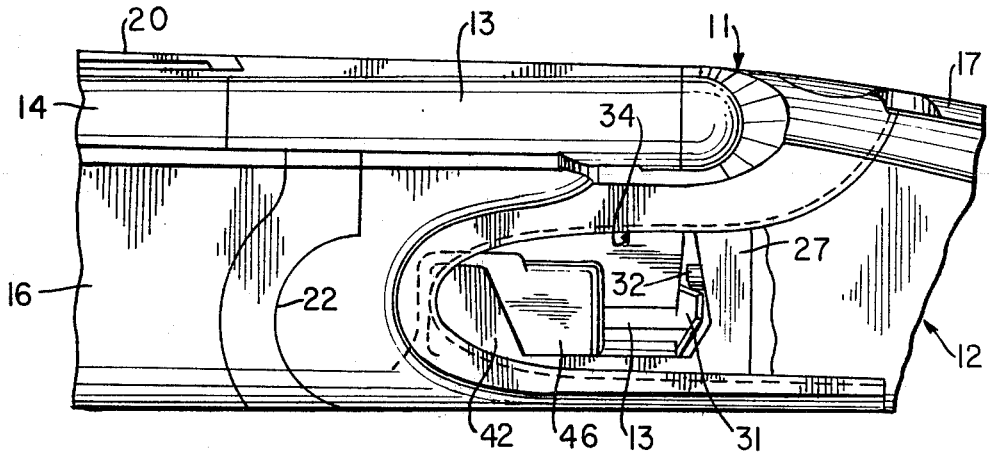
FIG. 4 is a fragmentary side elevation similar to FIG. 1 with the forwardly extending left hand side wall extension of the stock broken away to show the internal parts of the shotgun in this area.

As previously noted, in the lightweight stock and frame construction to which the present invention relates, the side walls of the metal frame 11 are formed with cut-out portions or openings that, as a result of the removal of an appreciable amount of metal from the side walls in this area of the frame, reduce the weight of the frame by a corresponding amount. In addition, the side walls of the wooden or plastic stock 12 are provided with forwardly extending portions that are received in the openings formed in the side walls of the frame to take the place of the metal removed from the frame in these areas. The side walls of the frame contribute little to the structural strength of the frame and serve mainly to cover and protect the internal mechanism of the shotgun in this area. (For example, if the forwardly extending portion on the left hand side of the stock 12 is broken away as shown in FIG. 4 of the drawings, the lower portion of the barrel receiving block 13, the barrel locking lug 31 and the barrel locking bolt 32 are visible through the opening formed in the left hand side of the frame.) Accordingly, a significant reduction in the weight of the firearm can be obtained without loss in strength or in performance of the arm.

In the particular embodiment of the invention shown in the drawings the right and left hand side walls of the frame 11 are formed with generally semi-elliptical cut-out portions or openings 33 and 34, respectively, each opening extending forwardly from the central portion 27 of the frame to a point located a short distance rearwardly of the hinge 22 at the forward end of the frame. The stock 12 is formed with right and left hand side wall extensions 35 and 36 that extend forwardly from the right and left hand side walls 29 and 30, respectively, of the stock, the right and left hand side wall extensions 35 and 36 each having a generally semi-elliptical configuration that conforms in shape to and is adapted to be snugly received in the corresponding semi-elliptical openings 33 and 34 formed in the side walls of the frame 11.

Figure 2:
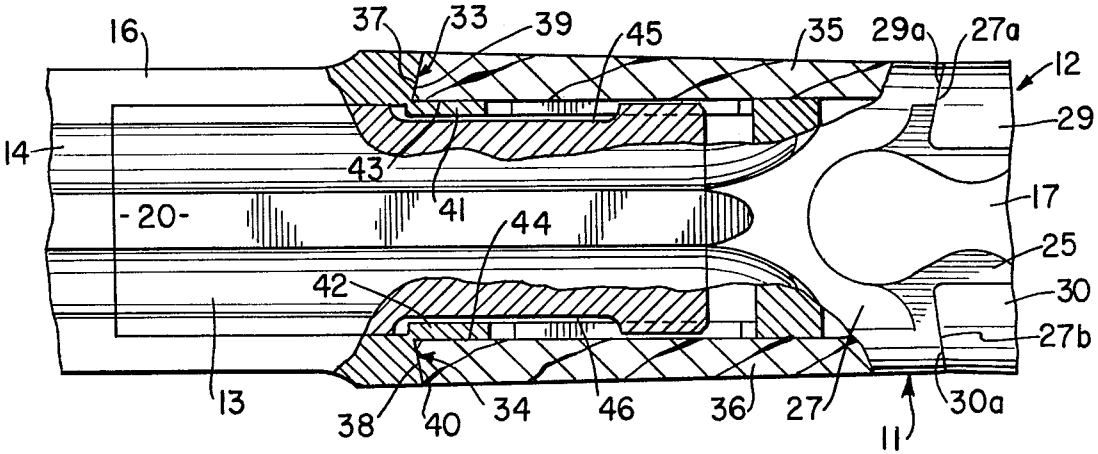
FIG. 2 is a fragmentary top view of the over-and-under shotgun partly broken away along line 2—2 of FIG. 1.

As best shown in FIGS. 5 and 6 of the drawings, the side walls 29 and 30 of the stock 12 have relatively thick cross-sections and consequently have considerable inherent resistance to flexing or bending. Moreover, as shown best in FIGS. 1 and 2, the forward facing bevelled surfaces **29*a* and 30*a* of the side walls 29 and 30 of the stock 12 are pressed firmly against the rearward facing bevelled surfaces 27*a* and 27*b* of the central portion 27 of the frame 11 by the screw 24, the mating bevelled surfaces of the stock and the frame cooperating with the upper and lower tang-like rearward extensions 25 and 26** of the frame to securely position the stock and to prevent lateral movement of the side walls 29 and 30 thereof. However, in contrast to the side walls 29 and 30, as shown best in FIGS. 5 and 6, the side wall extensions 35 and 36 of the stock 12 are relatively thin and have relatively little inherent resistance to flexing or bending with the shotgun is being handled and manual pressure is applied thereto. Any such bending or flexing of the side wall extensions 35 and 36 of the stock is undesirable when the shotgun is in use but has heretofore proven difficult to eliminate.

As previously noted, I have devised novel means for providing firm lateral support for the side wall extensions 35 and 36 of the stock 12. Specifically, the periphery of the right hand side wall extension 35 and the periphery of the left hand side wall extension 36 of the stock 12 are each formed with inwardly rising bevelled surfaces 37 and 38, and the periphery of the right hand side wall opening 33 and the periphery of the left hand side wall opening 34 of the frame 11 are each formed with inwardly undercut bevelled surfaces 39 and 40, the inwardly rising bevelled surfaces 37 and 38 of the stock 12 being adapted to contact snugly the inwardly undercut bevelled surfaces 39 and 40 of the frame 11 as shown in the drawings. In addition, the frame 11 is provided with a right hand inner support member 41 disposed on the inside surface of the right hand side wall of the frame adjacent the forward end of the right hand opening 33 formed therein and with a left hand inner support member 42 disposed on the inside surface of the left hand side wall of the frame adjacent the forward end of the left hand opening 34 formed therein, these inner support members 41 and 42 being adapted to contact the inner surfaces 43 and 44 of the right hand and left hand side wall extensions 35 and 36 when these side wall extensions are received in the right hand and left hand openings 33 and 34 formed in the frame. Thus, it will be seen that when the right hand and left hand forward extensions 35 and 36 of the stock 12 are received in the right hand and left hand side wall openings 33 and 34 of the frame 11 as shown in FIGS. 1–4 of the drawings, the inwardly rising bevelled surfaces 37 and 38 of the stock 12 cooperate with the inwardly undercut bevelled surfaces 39 and 40 of the frame 11 to prevent outward lateral movement of the side wall extensions 35 and 36 of the frame, and the right hand and left hand inner support members 41 and 42 of the frame cooperate with the inner surfaces 43 and 44 of the side wall extensions 35 and 36 of the stock to prevent inward lateral movement of the side wall extensions of the stock, thereby eliminating the undesirable inward and outward lateral movement of the side wall extensions previously referred to.

The barrel receiving block 13 is usually a rather massive metal casting or machined forging that occupies substantially all of the transverse space available between the right hand and left hand side walls of the frame 11. As a consequence, there ordinarily would be little or no room within the confines of the right hand and left hand side walls of the frame for the right hand and left hand inner support members 41 and 42, and without these inner support members the undesirable lateral movement of the right hand and left hand side wall extensions 35 and 36 of the stock would not be completely eliminated. I have now found that the interior space necessary to accommodate the right hand and left hand inner support members 41 and 42 can be provided by removing a small amount of metal from the right hand and left hand sides of the barrel receiving block 13 in an area where the removal of this metal will not materially affect the strength of the barrel receiving block 13 or the performance of the shotgun. Accordingly, as shown best in FIGS. 2 and 4, the right hand and left hand sides of the barrel receiving block 13 are formed with recessed areas 45 and 46 that are adapted to receive the right hand and left hand inner support members 41 and 42 of the frame.

I claim:

1. A lightweight stock and frame construction for a firearm having a frame the forward end of which is formed with a longitudinally extending open-top recess defined by right hand and left hand side walls, a bottom wall and rear end wall of the frame; a stock the forward end of which is secured to the rearward end of the frame; and at least one barrel pivotally mounted on the forward end of the frame for rotation from its closed "firing" position to its open "loading and unloading" position and return, the barrel being snugly received in the longitudinally extending open-top recess formed in the forward end of the frame when at its closed position;

the right hand side wall of the frame being formed with a longitudinallly extending right hand cut-out opening and the left hand side wall of the frame being formed with a longitudinally extending left hand cut-out opening, each of said openings extending forwardly from the rear end wall of the frame to a point a short distance rearward of the forward end of the frame, the periphery of the opening formed in the right hand side wall and the periphery of the opening formed in the left hand side wall of the frame each having an inwardly undercut bevelled surface;

the right hand side of the stock being provided with a right hand side wall extension and the left hand side of the stock being provided with a left hand side wall extension, said right hand and left hand side wall extensions of the stock each extending forwardly into the right hand and left hand side wall openings, respectively, of the frame and being snugly received in said openings, the periphery of the right hand side wall extension and the periphery of the left hand side wall extension of the stock each being formed with an inwardly rising bevelled surface that firmly contacts the inwardly undercut bevelled surface of the right hand and left hand side wall opening in which each side wall extension is received;

the right hand side wall and the left hand side wall of the frame each being provided with an inner support member disposed on the inner surface of each side wall at the forward end of the longitudinally extending cut-out opening formed therein, the inner support member at the forward end of the right hand side wall opening of the frame contacting the forward end of the inner surface of the right hand side wall extension of the stock received in said opening, and the inner support member at the forward end of the left hand side wall opening of the frame contacting the forward end of the inner surface of the left hand side wall extension of the stock received in said opening.

2. The lightweight firearm construction according to claim 1 in which the right hand and left hand longitudinally extending openings formed in the right hand and left hand side walls of the frame each have a generally semi-elliptical configuration the periphery of which has an inwardly undercut bevelled surface; and in which the right hand and left hand side wall extensions of the stock each have a generally semi-elliptical configuration that conforms to the configuration of the side wall opening of the frame in which they are received, the peripheries of said semi-elliptical side wall extensions having inwardly rising bevelled surfaces adapted to closely contact the inwardly undercut bevelled surfaces of the peripheries of the corresponding side wall openings of the frame.

3. The lightweight firearm construction according to claim 1 in which the rearward end of the frame is provided with upper and lower tang-like members that extend longitudinally rearwardly from the rear end wall of the frame; and in which the forward end of the stock is formed with a longitudinally extending cut-out portion adapted to receive the rearwardly extending tang-like members of the frame.

4. The lightweight firearm construction according to claim 1 in which a barrel-receiving block having at least one barrel secured to the forward end thereof is pivotally mounted on the forward end of the frame for rotation from the closed "firing" position to the open "loading and unloading" position of the barrels, and return.

5. The lightweight firearm construction according to claim 4 in which the right hand and left hand sides of the barrel-receiving block are formed with a right hand support member receiving recess and a left hand support member receiving recess, respectively, said right hand and left hand support member receiving recesses being adapted to receive the right hand and left hand inner support members, respectively, of the frame when the barrel-receiving block is at its closed position.

* * * * *